US009634417B2

(12) United States Patent
Ramanna et al.

(10) Patent No.: US 9,634,417 B2
(45) Date of Patent: Apr. 25, 2017

(54) POWER CONNECTOR

(71) Applicants: Nrupathunga Chakravarthy Somanathapura Ramanna, Mysore (IN); Krishna Prasad Darbal Somanath, Bangalore (IN); Chamarajanagar Gopala Raghavan, Bangalore (IN); Nyshil Belaay Pulukool, Kerala (IN); Joseph D. Comerci, Elmhurst, IL (US); Patrick J. Killian, Woodridge, IL (US)

(72) Inventors: Nrupathunga Chakravarthy Somanathapura Ramanna, Mysore (IN); Krishna Prasad Darbal Somanath, Bangalore (IN); Chamarajanagar Gopala Raghavan, Bangalore (IN); Nyshil Belaay Pulukool, Kerala (IN); Joseph D. Comerci, Elmhurst, IL (US); Patrick J. Killian, Woodridge, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/909,561

(22) PCT Filed: Jul. 30, 2014

(86) PCT No.: PCT/US2014/048801
§ 371 (c)(1),
(2) Date: Feb. 2, 2016

(87) PCT Pub. No.: WO2015/017501
PCT Pub. Date: Feb. 5, 2015

(65) Prior Publication Data

US 2016/0181716 A1 Jun. 23, 2016

Related U.S. Application Data

(63) Continuation-in-part of application No. 14/326,042, filed on Jul. 8, 2014, now abandoned.

(30) Foreign Application Priority Data

Aug. 2, 2013 (IN) ..... 921/KOL/2013

(51) Int. Cl.
*H01R 13/28* (2006.01)
*H01R 13/432* (2006.01)

(52) U.S. Cl.
CPC ..... *H01R 13/28* (2013.01); *H01R 13/432* (2013.01)

(58) Field of Classification Search
CPC ..... H01R 23/27; H01R 13/28; H01R 13/18; H01R 13/4223; H01R 4/185
(Continued)

(56) References Cited

U.S. PATENT DOCUMENTS 3,091,746 A * 5/1963 Winkler ..... H01R 13/28 439/295
3,676,833 A 7/1972 Johnson
(Continued)

FOREIGN PATENT DOCUMENTS

JP 2583488 Y2 10/1998
JP 3304686 B2 7/2002
KR 2002-0072317 A 9/2002

*Primary Examiner* — Thanh Tam Le
(74) *Attorney, Agent, or Firm* — James A. O'Malley

(57) ABSTRACT

A connector is disclosed including a housing and a pair of terminals. Each terminal includes a planar body portion and a planar mounting portion formed at the first end of the body portion with a bent contacting portion disposed therebetween. A wire securing portion is formed at the second end of the body portion with a pair of crimping portions to secure the wire to the terminal. The body portion and the mounting portion are received in a slot formed in the housing with the contacting portion extending through a window formed in the housing and the terminal mounting portion being translatable within the slot.

39 Claims, 16 Drawing Sheets

(58) Field of Classification Search
USPC ..... 439/284, 293, 295, 839, 595, 877
See application file for complete search history.

(56) References Cited

U.S. PATENT DOCUMENTS

| | | | | | |
|---|---|---|---|---|---|
| 3,909,099 | A * | 9/1975 | Winkler | H01R 13/562 | 439/295 |
| 4,083,617 | A * | 4/1978 | Wyatt | H01R 13/28 | 439/295 |
| 4,963,102 | A * | 10/1990 | Gettig | H01R 13/28 | 439/291 |
| 5,106,320 | A * | 4/1992 | Kinnear | H01R 13/114 | 439/295 |
| 5,174,777 | A * | 12/1992 | Carter | H01R 23/27 | 439/290 |
| 5,575,674 | A | 11/1996 | Davis et al. | | |
| 5,624,289 | A | 4/1997 | Kourimsky et al. | | |
| 6,071,152 | A * | 6/2000 | Achammer | H01R 13/41 | 439/733.1 |
| 6,948,970 | B2 * | 9/2005 | Hayashi | H01R 13/5816 | 439/457 |
| 7,153,152 | B1 * | 12/2006 | Eby | H01R 4/185 | 439/295 |
| 7,628,630 | B2 * | 12/2009 | Chang | H01R 13/426 | 439/295 |
| 7,695,330 | B2 * | 4/2010 | Noda | H01R 4/185 | 439/275 |
| 7,819,709 | B2 * | 10/2010 | Richter | H02S 40/34 | 439/452 |
| 7,828,612 | B2 * | 11/2010 | Kumakura | H01R 4/185 | 439/877 |
| 8,282,426 | B2 * | 10/2012 | Zweigle | H01R 13/41 | 439/499 |
| 8,845,362 | B2 * | 9/2014 | Chikusa | H01R 13/6275 | 439/595 |
| 8,864,533 | B2 * | 10/2014 | Morikawa | H01R 4/62 | 439/595 |
| 9,004,940 | B2 * | 4/2015 | Hasebe | H01R 13/4223 | 439/595 |
| 2009/0181580 | A1 | 7/2009 | Bethurum et al. | | |
| 2009/0279832 | A1 | 11/2009 | Andrei et al. | | |
| 2010/0075528 | A1 | 3/2010 | Ngo | | |

* cited by examiner

POWER CONNECTOR

RELATED APPLICATIONS

This application claims priority to Indian Provisional Application No. 921/KOL/2013, filed Aug. 2, 2013 and U.S. Utility application Ser. No. 14/326,042, filed on Jul. 8, 2014, both of which are incorporated herein by reference in their entirety.

FIELD OF THE INVENTION

The present invention relates to the field of connectors, more specifically the field of connectors suitable for providing power.

DESCRIPTION OF RELATED ART

There currently exists a need for wire to wire connector systems, in particular systems that transmit power. A particular issue is that a unique plug and receptacle connector are generally required for the connector system. It is required that the corresponding components in these connectors are assembled properly and correctly. Generally, each of the connectors includes an insulative housing and an electrically conductive terminal that is secured to the end of a cable or wire lead. Connector systems generally include a plug and receptacle with corresponding male and female electrically conductive terminals.

Each connector requires a plurality of terminated lead wires inserted into respective cavities in the housing. In some instances, the conductive terminal may not be inserted in the correct manner or the wrong terminal is used resulting in damage to the corresponding terminal and electrical failure. Therefore a power terminal is desired that eliminates the potential problems associated with a wire to wire connector system.

BRIEF SUMMARY

The present disclosure generally relates to an electrical power connector that can be integrated into a connector system and that can provide desirable operation under high current density conditions. In general, connectors are suitable for use as modular components within modular assemblies. For example, modular assemblies can take the form of wire-to-board or wire-to-wire connectors and can, when desired, provide a low-profile connector system.

A connector assembly may be provided that includes a hermaphroditic plug connector and a receptacle connector including one or more hermaphroditic blade-type power contacts disposed in each of the connector housings. The plug and receptacle connectors are slidably mateable with each other and include corresponding molded cavities to receive the electric terminals therein.

In an embodiment the terminals are constructed with a planar body portion and a planar securing portion with a bent beam contacting portion disposed therebetween. The cavities include a terminal retention slot for securing the planar sections of the terminal within the housing cavity. Additionally the planar portions of the terminal are constructed so that interference exists between the planar portions of the terminal and certain cavity openings and terminal orientations prohibiting incorrect assembly of the terminals to the housing cavities.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
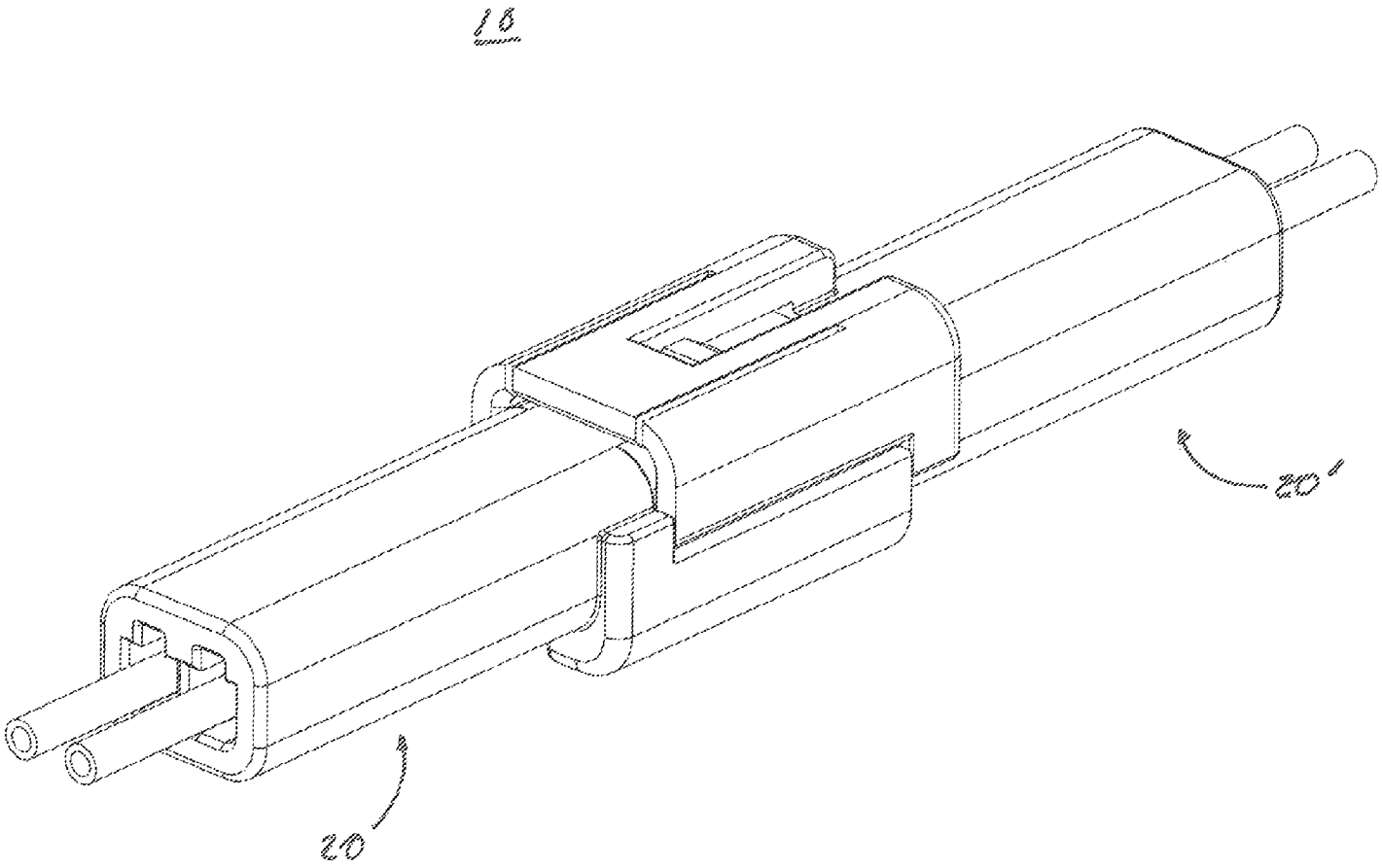
FIG. 1 is a perspective view of an embodiment of a power connector assembly.
Figure 2:
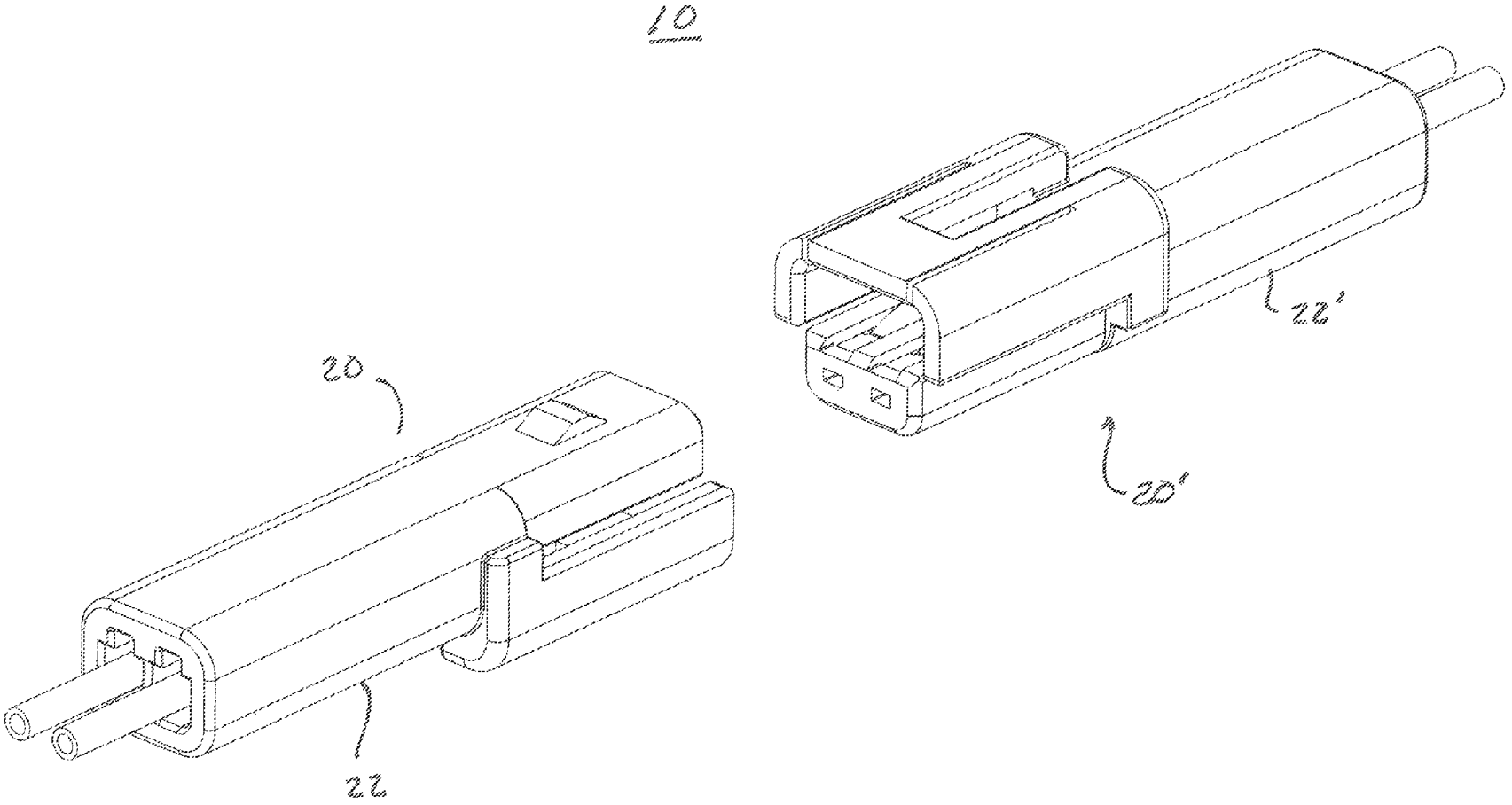
FIG. 2 is an unmated perspective view of the power connector assembly of FIG. 1.
Figure 3:
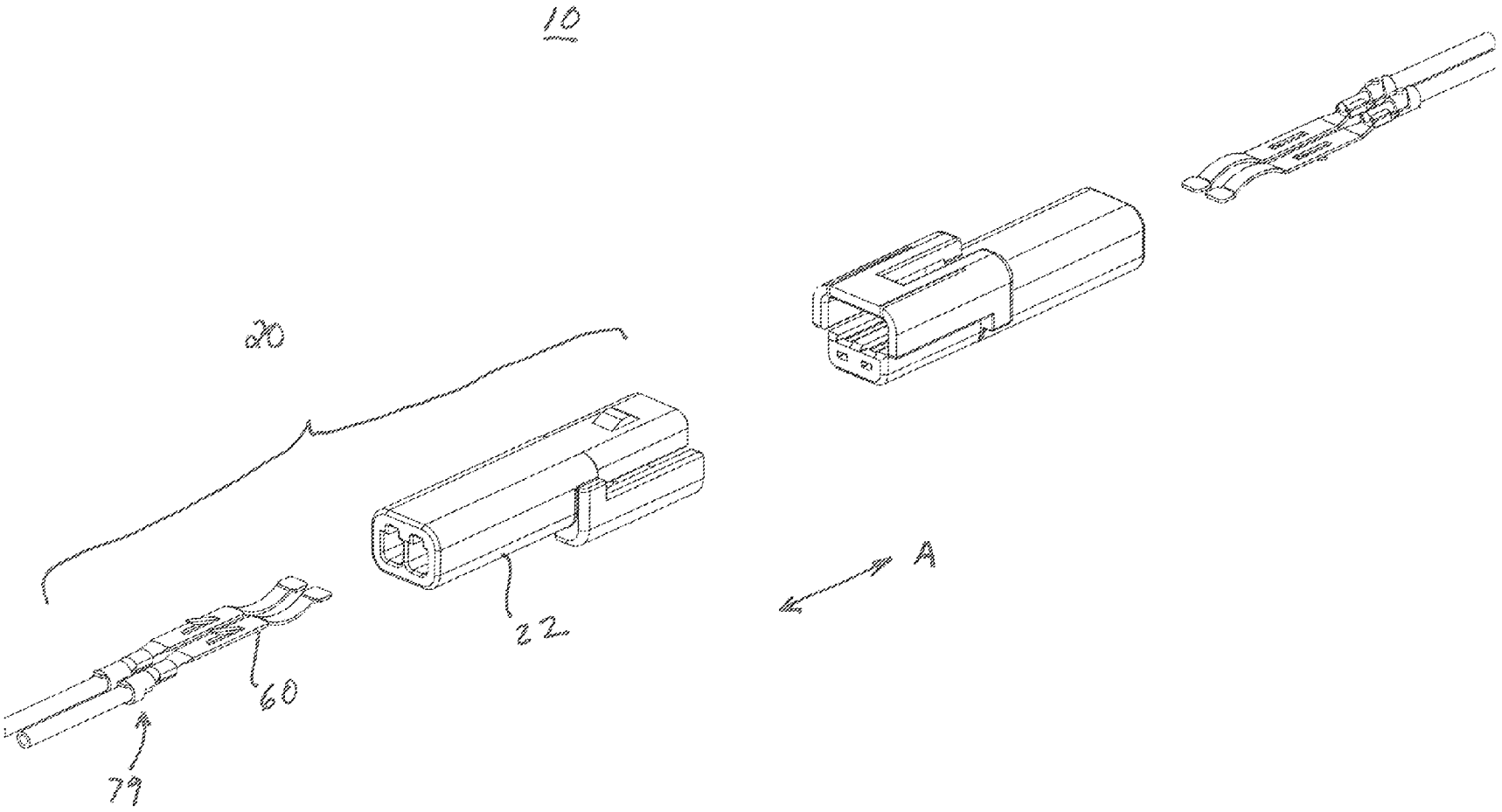
FIG. 3 is an explode view of the power connector assembly of FIG. 1.

FIGS. 1-3 illustrate an embodiment of the present invention and it is to be understood that the disclosed embodiment is merely exemplary of the invention, which may be embodied in various forms. Therefore, specific details disclosed herein are not to be interpreted as limiting, but merely as a basis for the claims and as a representative basis for teaching one skilled in the art to variously employ the present invention.

As shown in FIGS. 1-3 a wire to wire connector system 10 is depicted has having a first connector 20 and a second connector 20' that are removably locked together. The connector system 10 is of the hermaphroditic type, that is, that each connector 20, 20' is a duplicate and can be connected together with itself. As can be appreciated, the electrical terminals 60, 60' are also hermaphroditic and can connect to themselves.

Figure 4:
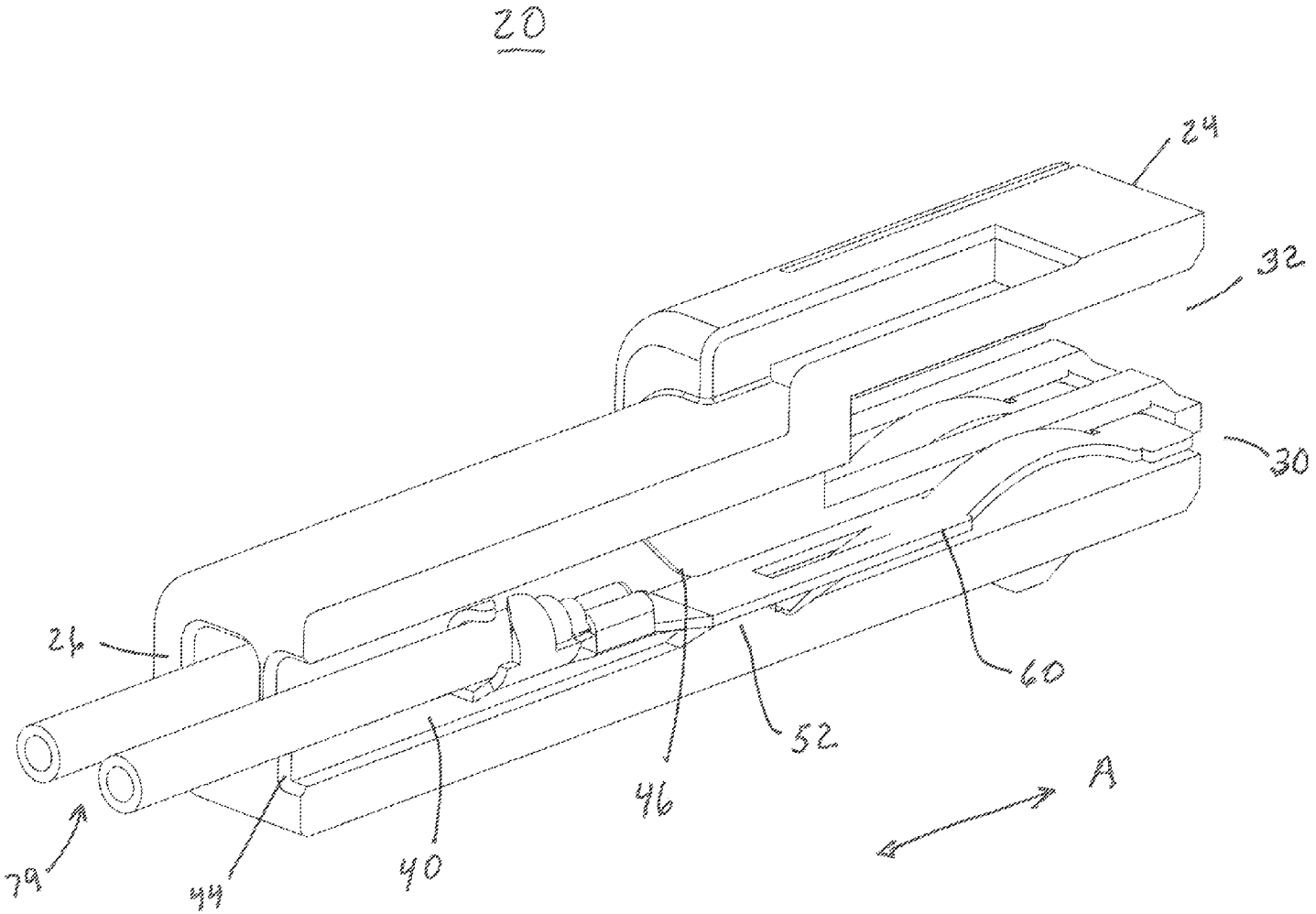
FIG. 4 is a sectional view of a power connector of FIG. 1.
Figure 5:
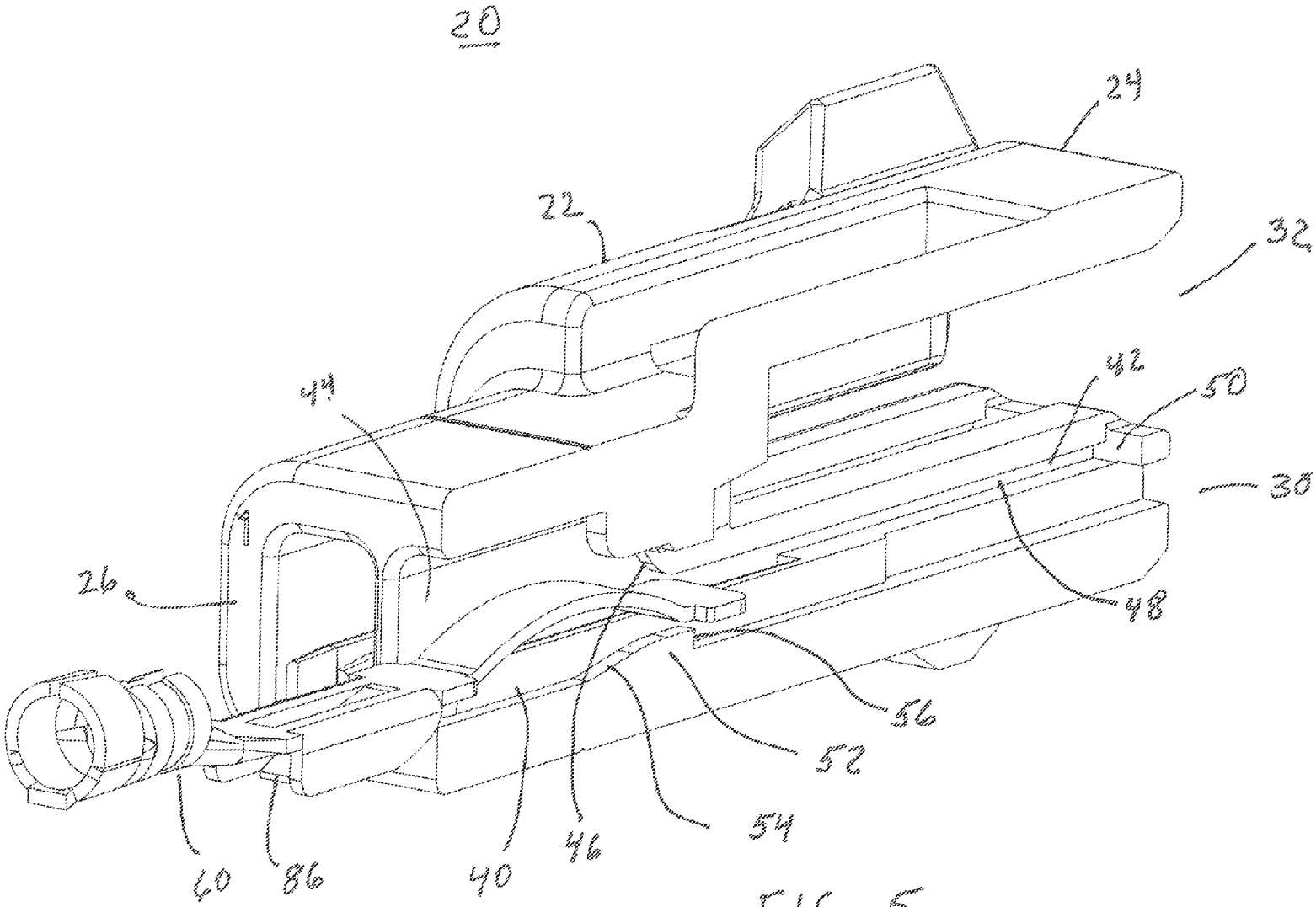
FIG. 5 is a sectional view of the power connector with a partially inserted terminal.

As shown in the FIG. 2 the hermaphroditic power connector system 10 includes a first connector 20 and a second connector 20'. Since both the first connector 20 and the second connector 20' are exactly the same, only one of the connectors 20 shall be described. FIG. 4 shows the connector 20 including an insulative housing 22 having a terminal receiving portion 30 and an opening 32, whereby the opening 32 is configured to accept the terminal receiving portion 30 of the mating or second connector 20'. The terminal receiving portion 30 includes a cavity 40 for receiving terminals 60, which are electrically conductive, therein with an opening or window 42 on the surface of the terminal receiving portion 30 facing the opening 32. The cavity 40 is formed along the mating axis A of the connector 20 with a front end 24 corresponding to the mating end of the connector 20 and a rear receiving end 26 with a cavity opening 44 in the rear portion 26 for receiving the terminal 60 upon assembly.

As best shown in FIG. 4, the cavity portion 40 of the connector housing 22 includes a main opening 44 adjacent the rear portion 26 of the connector housing 22 extending forward to a ramped portion or projection 46 formed in the cavity 40 at about the midpoint of the cavity 40. A slot 48 is disposed on each lateral side of the cavity 40 extending from the ramped or biasing portion 46 forward to the mating end 24 of the connector housing 22. Each slot 48 has an end or stop surface 50 positioned at the mating end 24 of the connector housing 22. A projection 52 is formed in the bottom surface of the cavity 40 having an angled section 54 facing the rear 26 of the connector 20 and a shoulder section 56 facing the mating end 24 of the connector housing 22. Opposed to the projection 52 on the bottom surface of the cavity 40 is the ramped projection or biasing portion 46, which is formed on the upper surface of the cavity 40 in the connector housing 22.

As illustrated in FIGS. 3-6, a terminal 60 is provided and includes a flat planar body portion 62 having a wire securing portion 64 disposed at a first end 66 of the body portion 62 for securing a conductor or wire 80 to the terminal 60. The terminal 60 is designed to mate with another terminal 60 and thus may be considered hermaphroditic. The wire securing portion 64 includes a first set of wings 63 formed adjacent the body portion 62 and a second set of wings 65 formed adjacent the first set of wings 63. Both sets of wings 63, 65 are formed in a first or upward direction U. A conductor or wire 80 having an insulative jacket or covering 81 with a portion of the wire 83 having the cover 81 stripped or removed is secured to the terminal 60 by crimping the first pair of wings 63 over the bare wire portion 83 and crimping the wire 80 over the covering 81 with the second pair of wings 65. Additionally, a cantilevered locking tang 86 is formed from the main body portion 62 and extends in a second or downward direction D.

Figure 6:
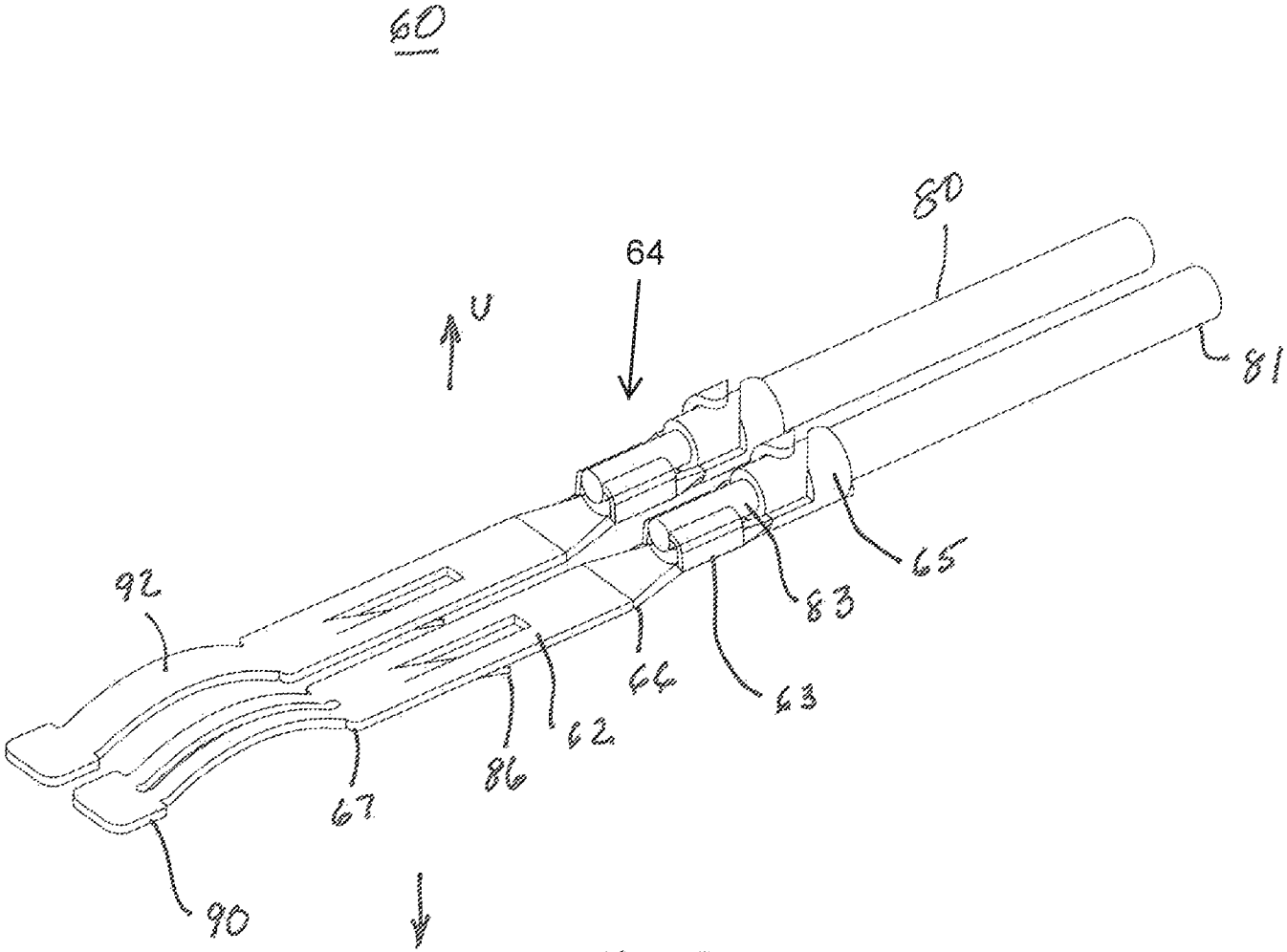
FIG. 6 is a perspective view of the terminals of the power connector of the disclosure.
Figure 7:
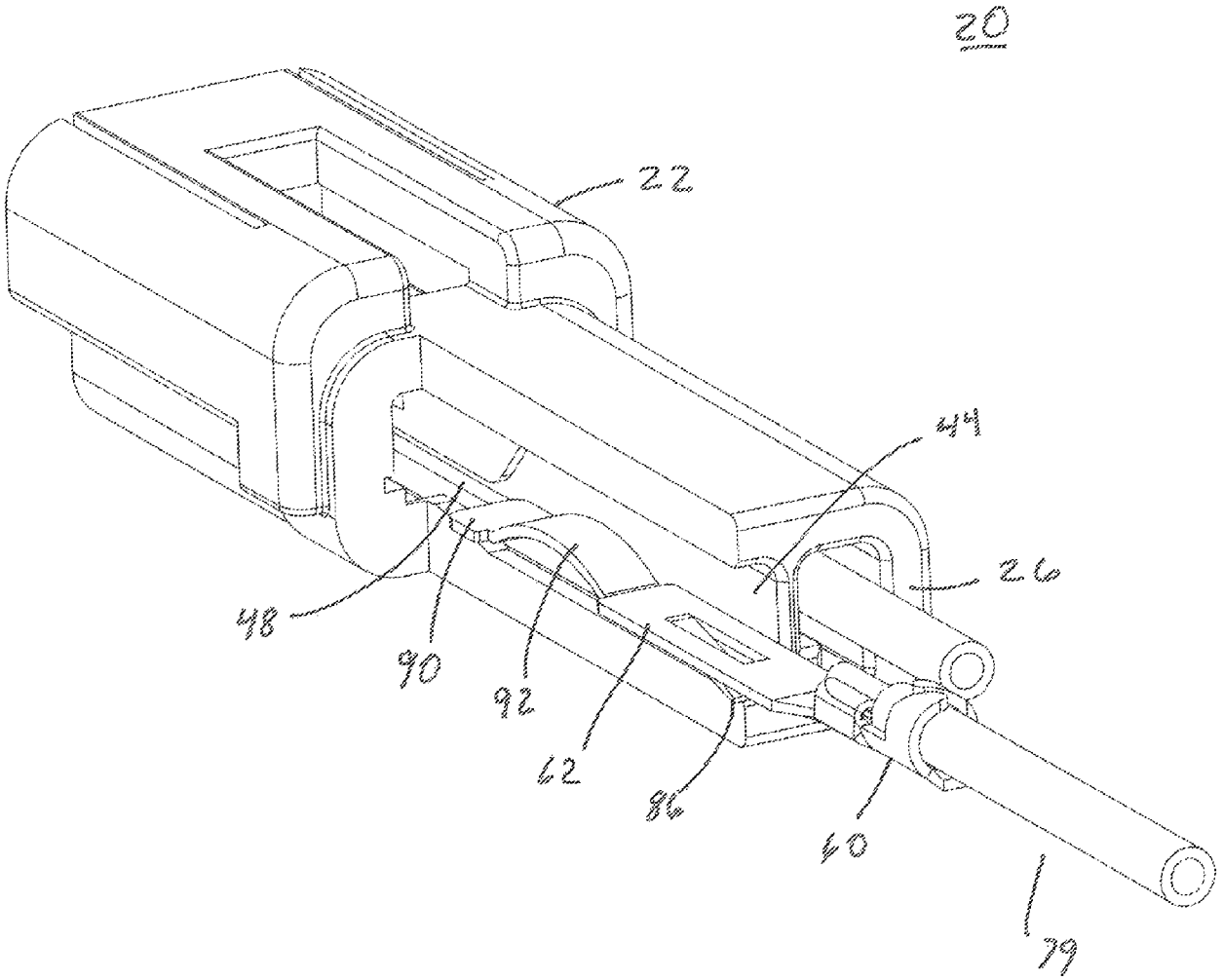
FIG. 7 is a partial sectional view of the power connector of FIG. 1.

As shown in FIG. 6 a flat planar terminal mounting portion 90 is disposed at a second end 67 of the main body portion 62 and a bent contacting portion 92 is disposed between the planar mounting portion 90 and the planar body portion 62. The main body portion 62 and the mounting portion 90 have a first width W1 and the bent beam portion or contacting portion 92 has a second width W2 in which the second width W2 is less than the first width W1. In this embodiment the main body portion 62 and the mounting planar portion 90 are coplanar. In other arrangements the body portion 62 and the mounting portion 90 may lie on different planes.

As illustrated in FIG. 6, the bent contacting portion 92 is shown as a convex arc extending in the first direction U, alternative configurations for the contacting portion 92 may be used, such as an elliptical section or even a second planar section. The contacting portion 92 is illustrated as a continuous section, but alternatively it can be split into multiple beam portions or segments as shown in FIG. 6; and the cross section may also be modified to exact a change or alter the flexing or spring characteristics of the beam 92.

FIGS. 7-10 illustrate the insertion process of each lead wire assembly 79 into its respective terminal receiving cavity 40 in the connector housing 22. The cavity 40 includes an opening 44 in the rear portion 26 of the connector housing 22 in which the terminal 60 of the lead wire assembly 79 is inserted and a slot 48 formed in a transverse direction to the opening 44. In order for proper insertion of the terminal 60, the mounting portion 90 of the terminal 60 must first be guided into the transverse slot 48. The slot 48 has a height conforming to the thickness of the flat planar body portion 62 and the flat planar mounting portion 90 of the terminal 60 to assure that the planar portions 62, 90 of the terminal 60 are held in alignment and maintain the proper height of the contacting portion 92 of the terminal 60.

Figure 11:
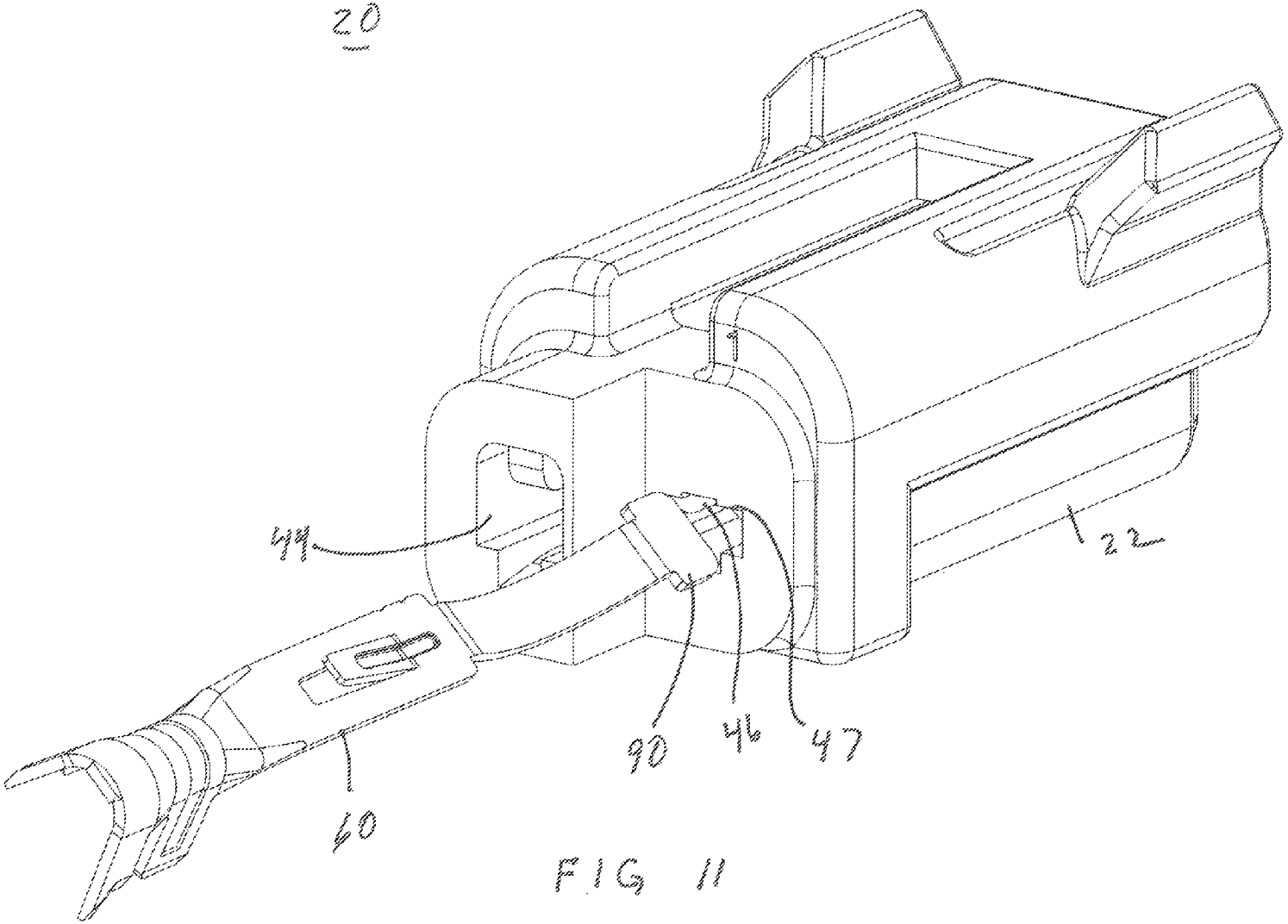
FIG. 11 is a sectional view of a misaligned terminal prior to insertion.
Figure 12:
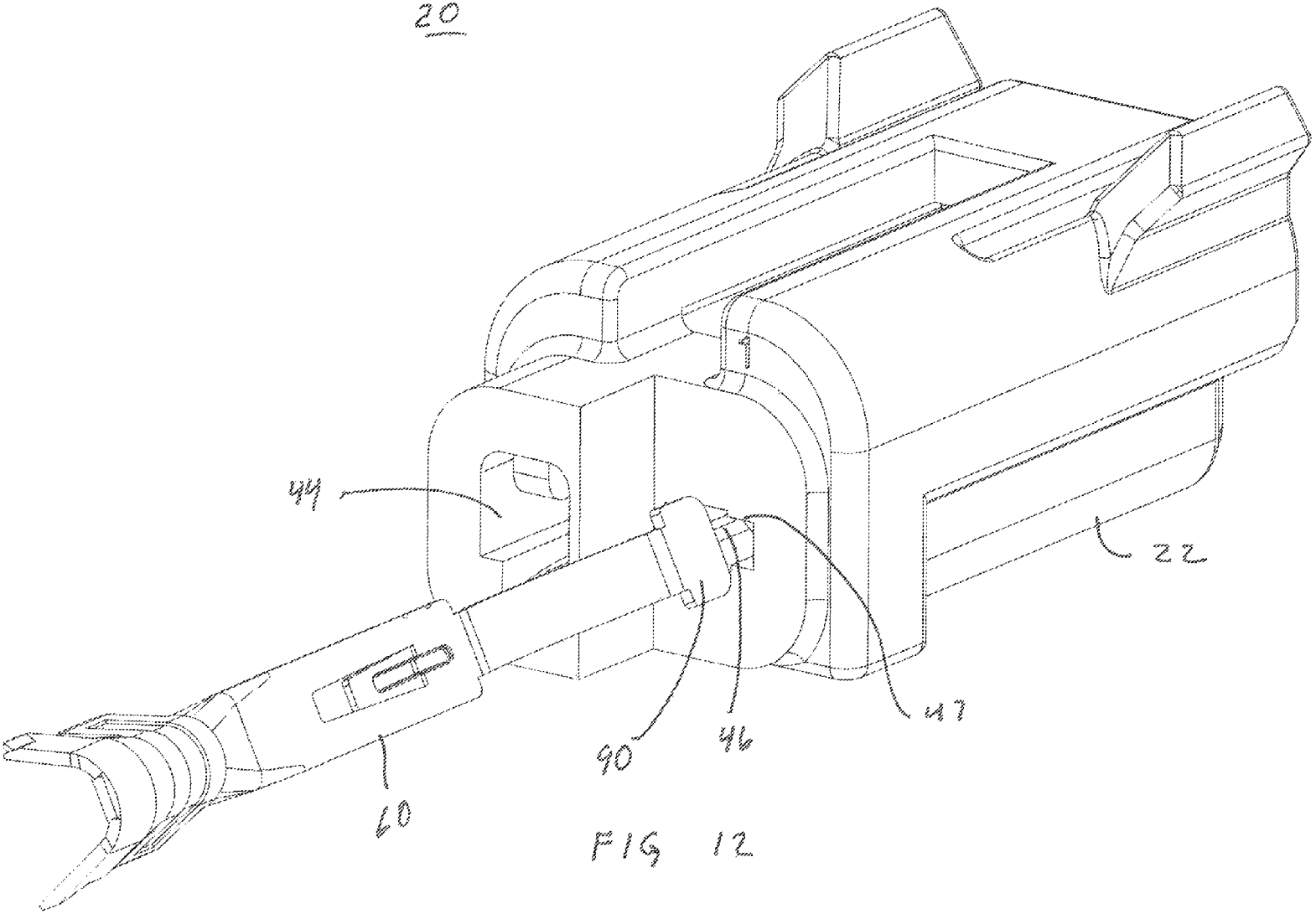
FIG. 12 is a sectional view of a misaligned terminal prior to insertion.

Upon insertion, the planar mounting portion 90 of the terminal 60 is first aligned with the opening 44, in particular the planar mounting portion 90 is inserted into the opening 44 and upon further insertion is aligned or guided into the slots 48 by the curved or ramped projections 46. As best shown in FIGS. 11 and 12 the opening 44 is also configured so that a diagonal distance across the opening 44 or the largest possible distance across the opening 44 is less than the entire width W1 of the planar mounting portion 90 of the terminal 60. As further illustrated in FIG. 13 the diagonal distance across the opening 44 is shown as U1 and U2; in both instances U1 and U2 are less than width W1 of the mounting portion 90. In this case, the edges of the planar mounting portion 90 will engage or abut the housing 40 and cannot be inserted into the cavity 40 in a wrong or misaligned position, thereby reducing the possibility for terminal damage.

Figure 8:
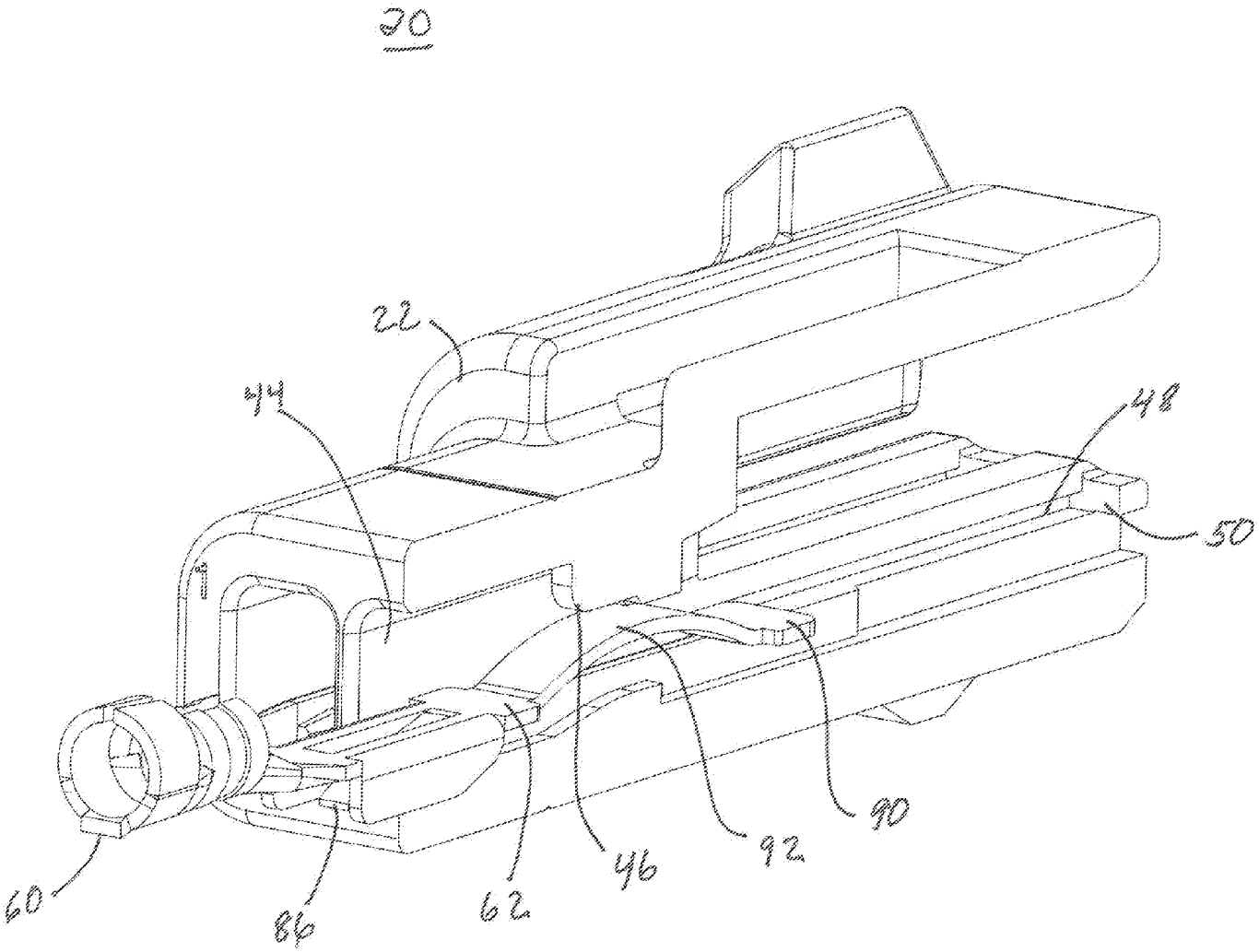
FIG. 8 is a sectional view of the power connector with a partially inserted terminal.
Figure 10:
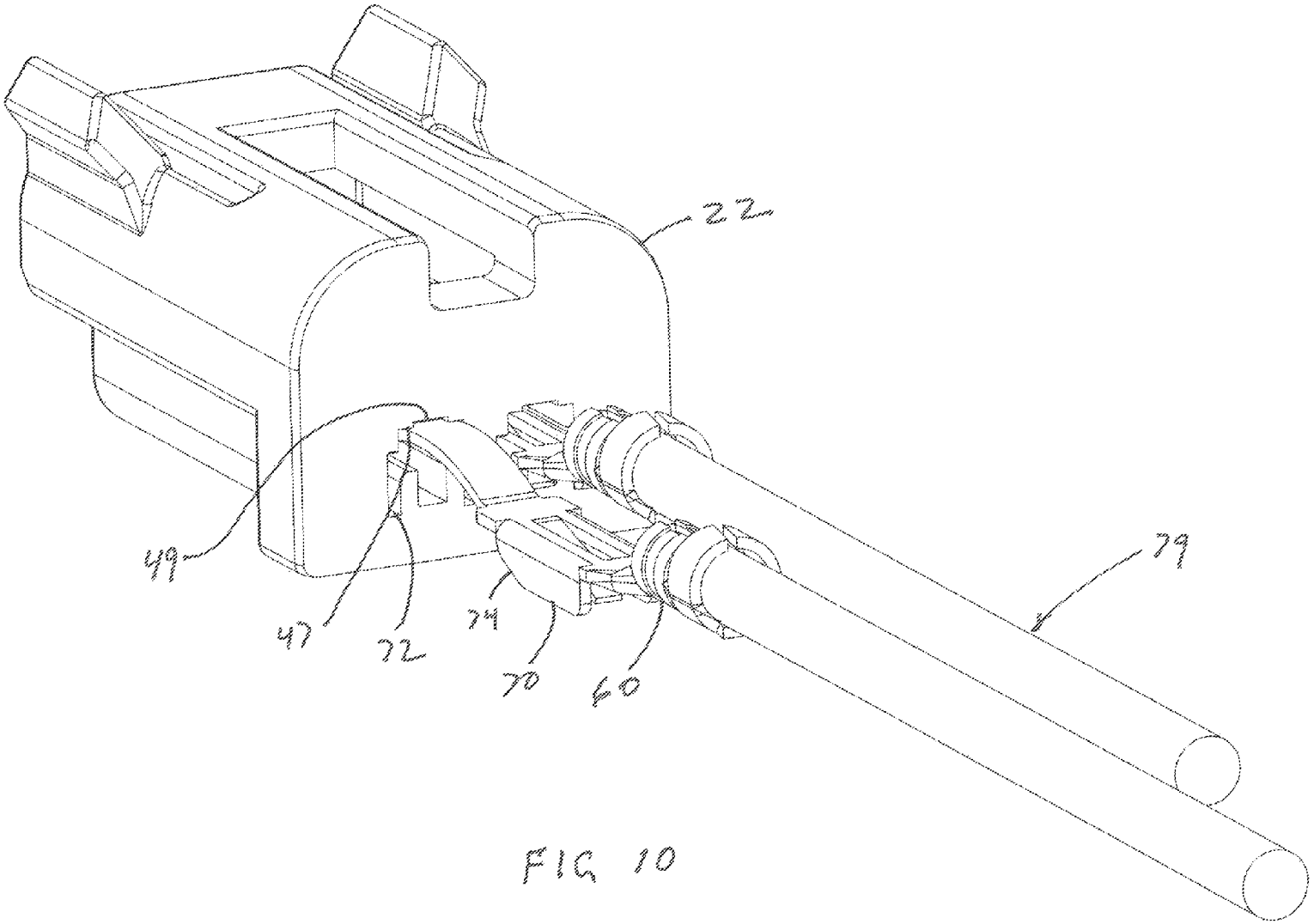
FIG. 10 is a sectional view of the power connector with a partially inserted terminal.

At this point, as depicted in FIG. 8 during the insertion of the terminal 60 the ramped projection 46 in the housing 22 engages the arc shaped contacting portion 92 so as to create a pre-load or bias therefore providing a three to the terminal 60 in a downward or second direction D. This bias keeps the flat planar mounting portion 90 and flat planar main body portion 62 of the terminal 60 in constant contact with the bottom surface of the slot 48. The ramped projection 46 also includes a flat portion 47 with a longitudinal recess 49 formed in the middle portion of the projection 46, whereby the recess 49 eliminates contact with the middle or central portion of the arc shaped contacting area 92. As best shown in FIG. 10, the projection 46 only makes contact with the contacting portion 92 of the terminal 60 only on the outer areas or edges of the arc shaped contacting portion 92 therefore minimizing contact between the terminal 60 and the ramped projection 46 and thereby reducing wear and damage to the terminal plating in the area of electrical contact.

Figure 9:
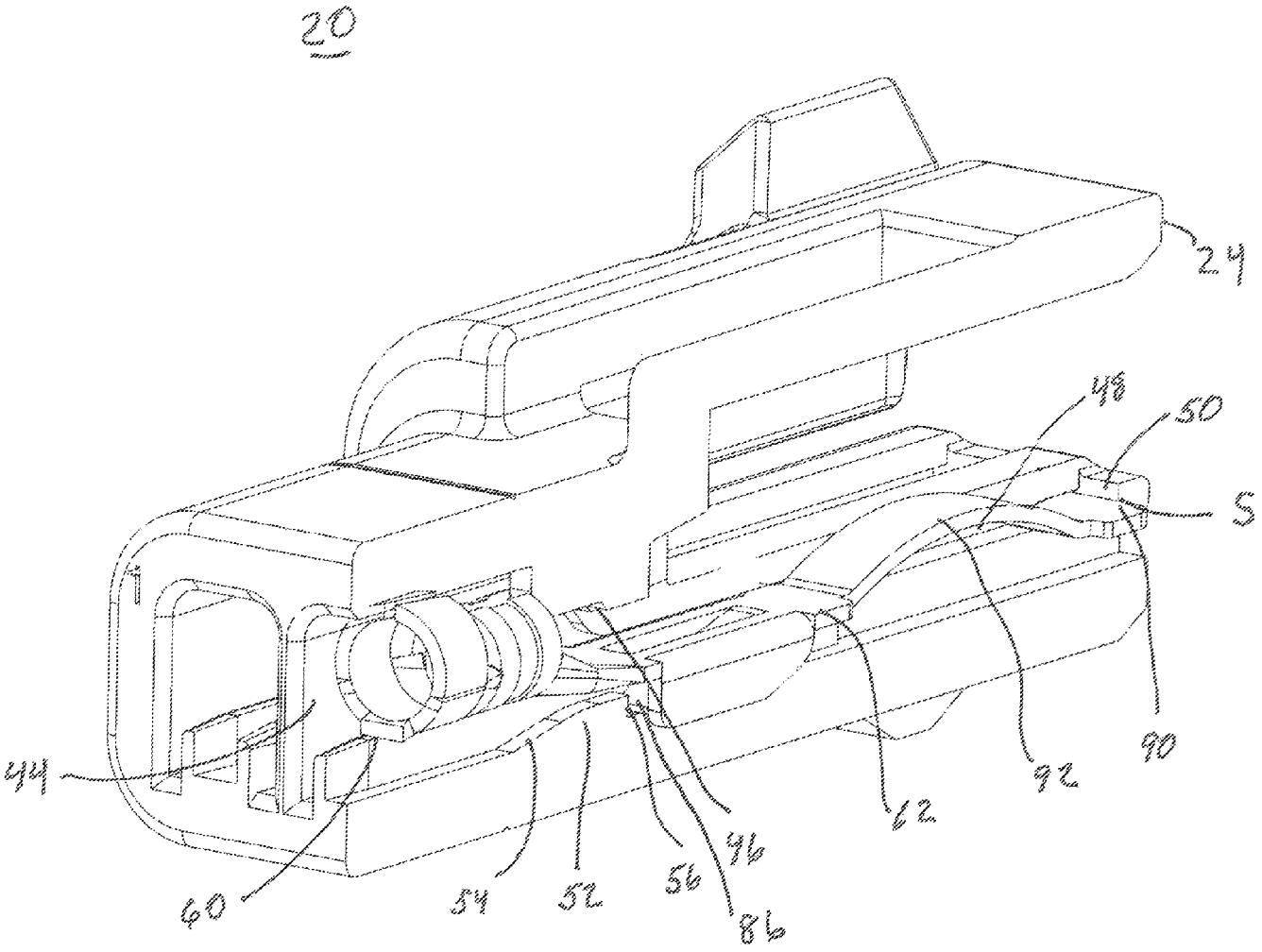
FIG. 9 is a sectional view of the power connector with a completely inserted terminal.

Upon further insertion, the locking tang 86 extending from the main body portion 62 engages the projection 52 in the bottom surface of the cavity 40. The ramped end 54 of the projection 52 engages the tang 86 and forces the tang 86 upward as the terminal 60 is advanced in the cavity 40. The tang 86 rides over the projection 52 to the point where the tang 86 snaps back into its original position behind the shoulder 56 of the projection 52 so that the trailing or back edge of the tang 86 engages the shoulder 56 and locks the terminal 60 in the cavity 40. Upon complete insertion of the terminal 60 in the cavity 40, as shown in FIG. 9, the planar mounting portion 90 of the terminal 60 resides in a front portion 24 of the cavity slot 48 but does not extend to the end of the slot 48. A space S exists between the front edge of the planar mounting portion 90 of the terminal 60 and the stop or end surface 50 of the slot 48 allowing for the planar mounting portion 90 to translate along a mating direction A within the slot 48.

Figure 13:
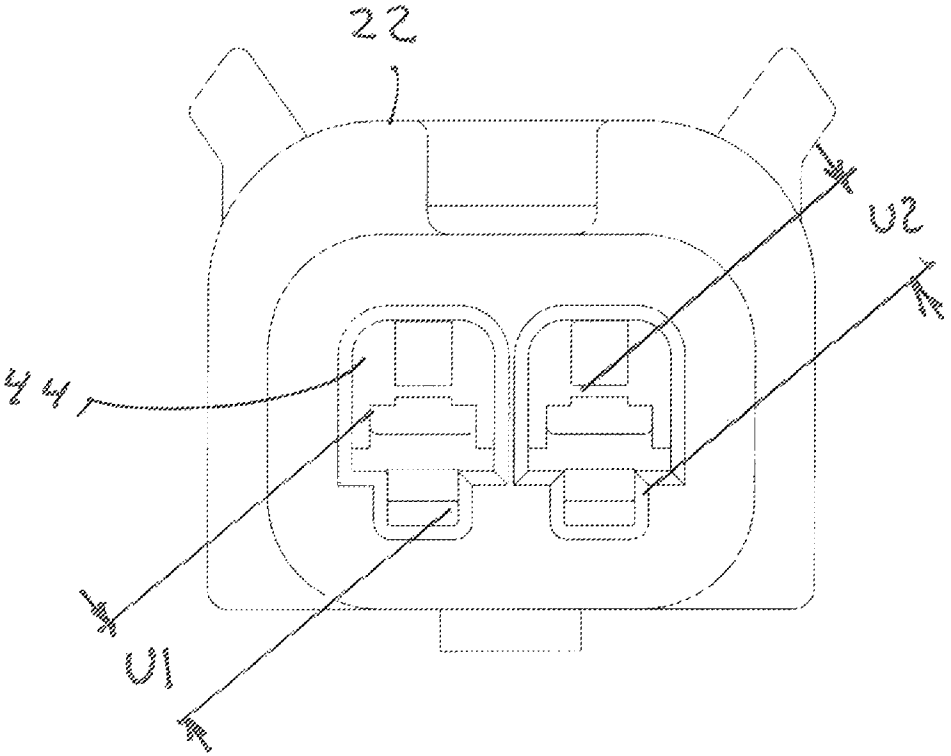
FIG. 13 is an end view of the connector housing without a terminal.

As best shown in FIG. 13 the bent arc portion 92 of the electrical terminal 60 extends through the window 42 formed in the terminal receiving portion 30 facing the opening 32 in the connector housing 22. Upon mating of the first and second connectors 20, 20', the terminal receiving portion 30 of the first connector 20 is received in the opening of the second connector 20' and similarly the terminal receiving portion 32' of the second connector 20' is received in the opening 32 of the first connector 20. In this arrangement respective arc shaped contacting portions 92 of the electrical terminals 60 protruding out of windows 42 of each of the connector housings 22 respectively engage each other. With the respective engagement of the mating terminals 60, the bent arc portions 92 are deflected upon mutual engagement and tend to flatten out. This causes the planar mounting portion 90 of each electrical terminal 60 to translate in the slot 48 allowing for proper electrical engagement between the terminals 60.

Figure 14:
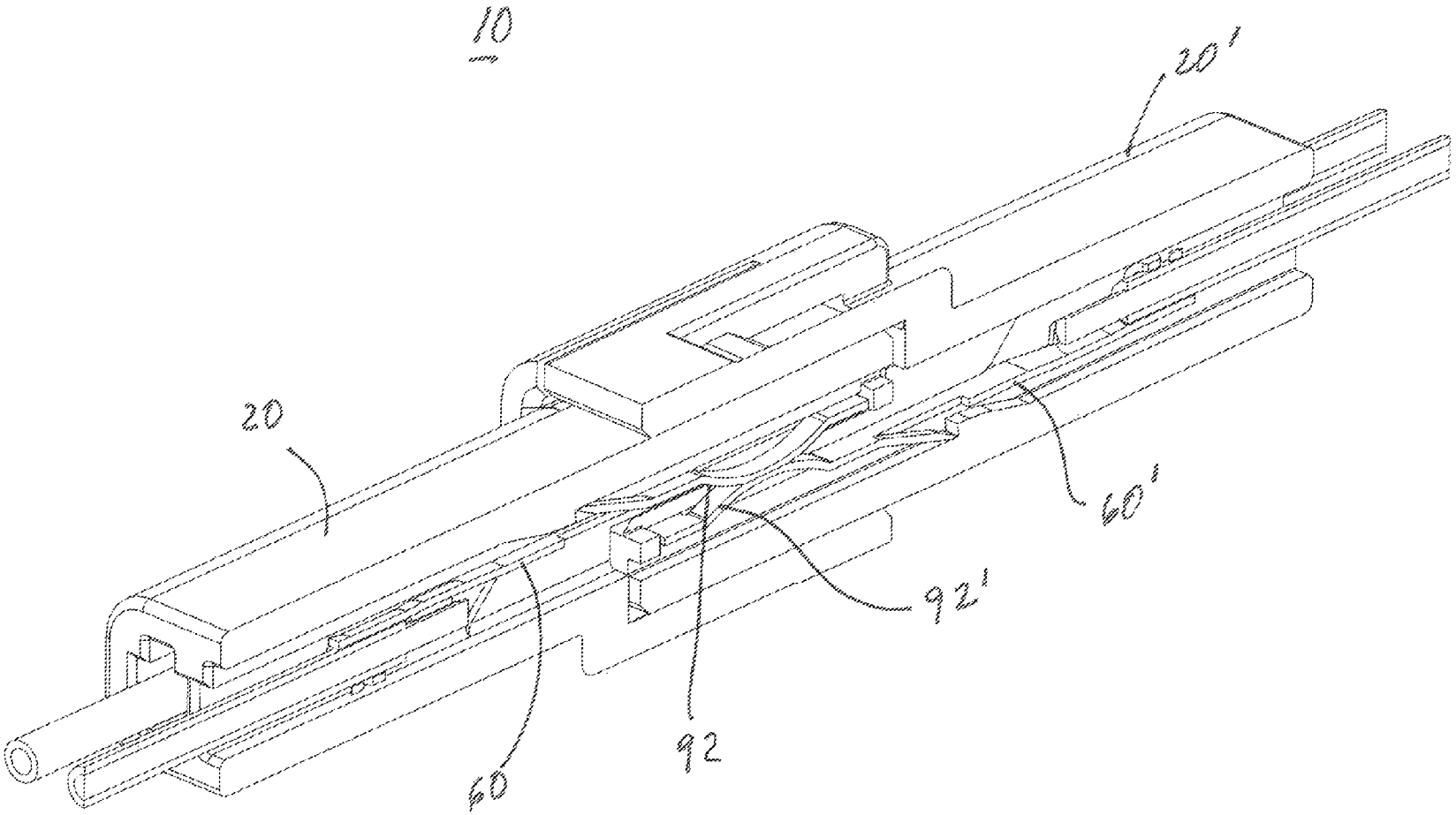
FIG. 14 is a section view of the mated power connector assembly.
Figure 15:
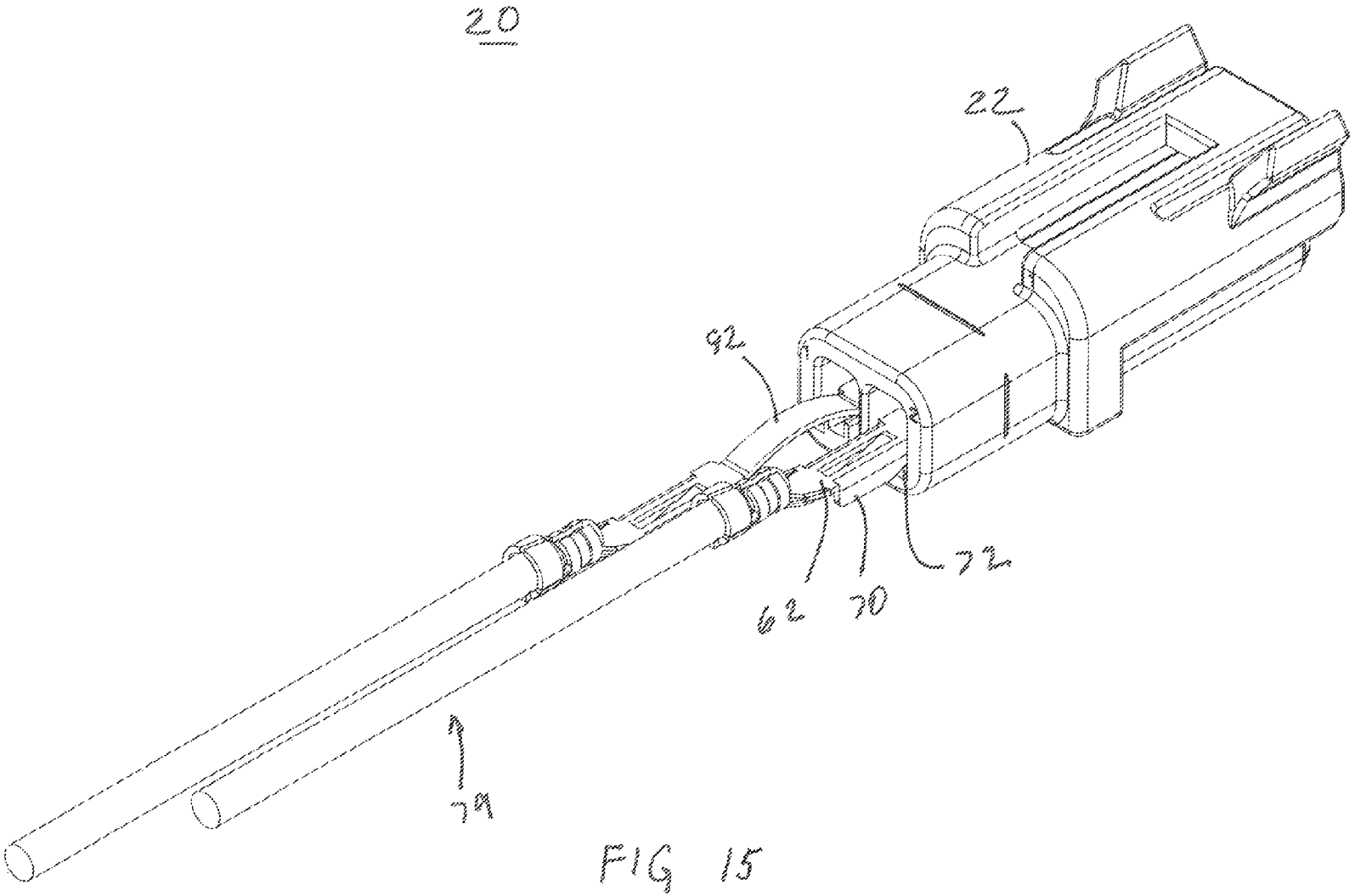
FIG. 15 is a perspective view of an alternative embodiment of a power connector with a partially inserted terminal.
Figure 16:
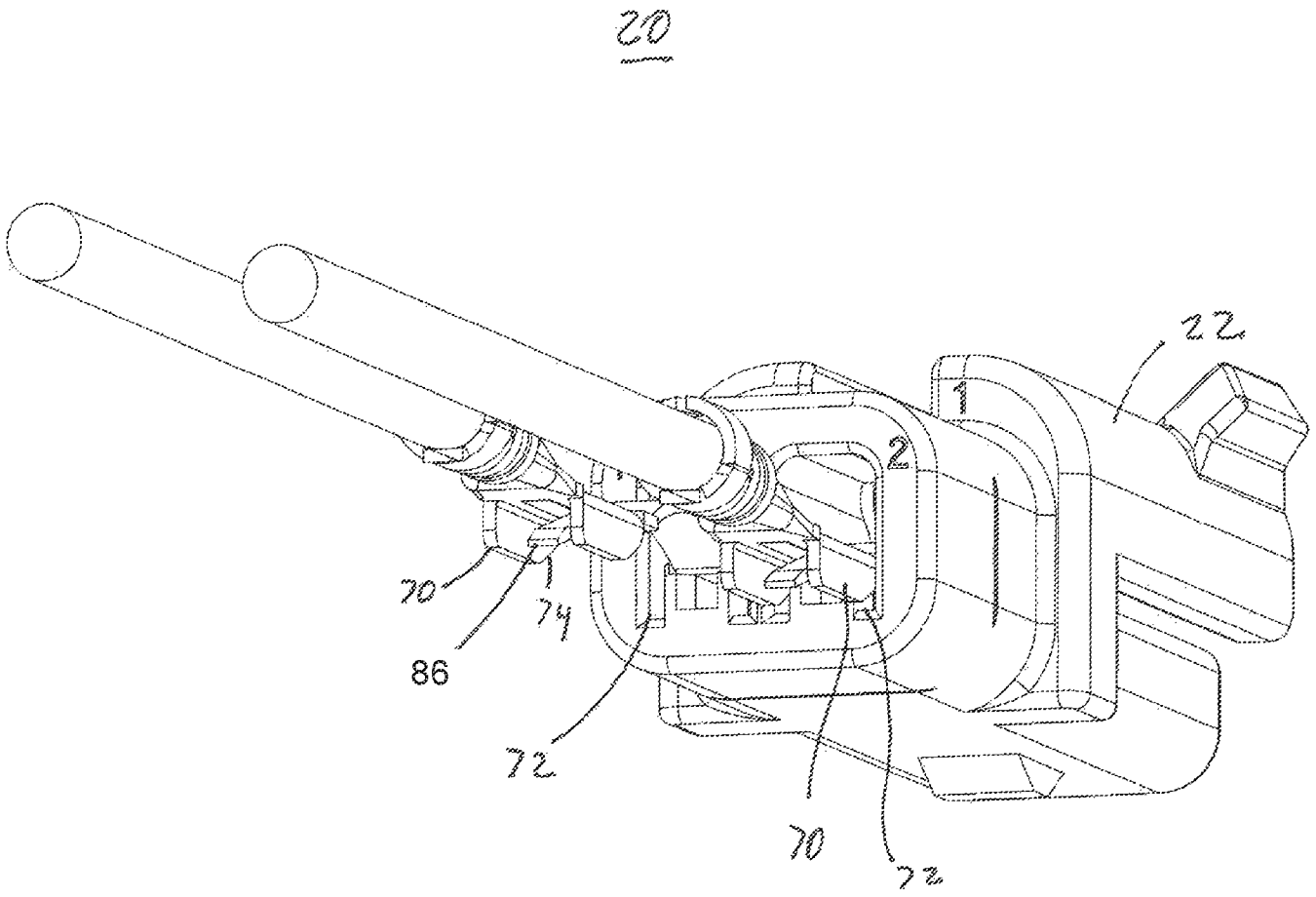
FIG. 16 is another perspective view of the power connector of FIG. 14.

Shown in FIGS. 14-15 is an alternative embodiment and accordingly, in addition to the construction of the electrical terminal 60 described above, the electrical terminal 60 of the alternate embodiment includes a pair of aligning ribs 70 formed from the main body portion 62 of the terminal 60 as best illustrated in FIG. 15. The ribs or tabs 70 are bent in a direction opposite to the convex arc contacting portion 92, that is, the contacting beam 92 is bent upward U from the main body portion 62 of the terminal 60 and the aligning ribs 70 are bent downward D. The aligning ribs 70 are formed in this direction so that the ramped projection 46 can contact the bent beam contacting portion 92. If the cavity 40 was modified to accommodate the aligning ribs 70 formed in an upward direction, the ramped projection 46 could not be molded in the cavity 40. During the foaming process of the electrical terminal 60, for ease of manufacture, all bends or formed structure are generally formed in the same direction, for instance, the wire crimping portions or wings 63, 65 and the aligning ribs 70 would each have their free ends pointing in the same direction, but in this case due to the ramped projection 46 being formed in the cavity 40, it cannot and the described aligning ribs are formed in opposite directions.

A pair of receiving grooves 72 corresponding to the aligning ribs 70 is formed in the housing 22 for receiving the ribs 70 upon insertion of the terminal 60 in the housing 22. Additionally, the aligning ribs 70 have a ramped or lead-in portion 74 formed on its leading end and are positioned on both sides of the main body portion 62 with the locking tang 86 disposed between the ribs 70. The lead-in portions 74 aid in the aligning of the terminal 60 upon insertion into the cavity portion 40 of the housing 22. In this configuration, the ribs 70 are formed larger that the exterior envelope of the locking tang 86 that is, due to the size and shape of the ribs 70 the locking tang 86 is shielded or protected against any objects coming in contact with the locking tang 86 and damaging it.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

The invention claimed is:

1. A connector comprising:

a housing, the housing including a terminal receiving cavity, the terminal receiving cavity includes a first end and a second end, the terminal receiving cavity having an opening at the first end and a transverse slot formed in the cavity extending to a stop surface formed at the second end; and a terminal positioned in the terminal receiving cavity, the terminal including a planar body portion and a planar mounting portion, the terminal including a contacting portion disposed between the body portion and the mounting portion, the mounting portion having a front edge, wherein a space is defined between the front edge of the mounting portion of the terminal and the stop surface of the slot formed at the second end of the cavity, the terminal further including a wire securing portion, the body portion being disposed between the wire securing portion and the contacting portion, the wire securing portion having a first portion configured to secure an exposed portion of a wire and a second portion configured to secure a covered portion of the wire, wherein the first portion is disposed between the second portion and the body portion.

2. The connector of claim 1, wherein the body portion and the mounting portion are coplanar.

3. The connector of claim 1, wherein the body portion and the mounting portion have a first width and the contacting portion has a second width.

4. The connector of claim 3, wherein the first width is greater than the second width.

5. The connector of claim 1, wherein the mounting portion has a width that is less than a width of the body portion.

6. The connector of claim 1, wherein the contacting portion is formed as arc shaped.

7. The connector of claim 1, wherein the mounting portion is configured to translate in a mating direction.

8. The connector of claim 1, wherein the terminal receiving cavity includes a ramped portion configured to engage the contacting portion of the terminal.

9. The connector of claim 8, wherein the ramped portion includes a flat portion defining a longitudinal recess.

10. The connector of claim 1, wherein the first portion of the wire securing portion is a first pair of wings, and wherein the second portion of the wire securing portion is a second pair of wings.

11. A connector comprising:

a housing, the housing including a terminal receiving cavity, the terminal receiving cavity including a first end and a second end, the terminal receiving cavity having an opening at the first end and a transverse slot formed in the cavity extending to the second end, wherein the opening provides a diagonal distance between opposing corners; and a terminal positioned in the terminal receiving cavity, the terminal includes a planar body portion and a planar mounting portion with a contacting portion disposed between the body portion and the mounting portion, the body portion and the mounting portion having a first width and the contacting portion having a second width, wherein the first width is greater than the diagonal distance, the terminal further including a wire securing portion, the body portion being disposed between the wire securing portion and the contacting portion, the wire securing portion having a first portion configured to secure an exposed portion of a wire and a second portion configured to secure a covered portion of the wire, wherein the first portion is disposed between the second portion and the body portion.

12. The connector of claim 11, wherein the body portion and the mounting portion are coplanar.

13. The connector of claim 11, wherein the width of the contacting portion is less than the width of the body portion.

14. The connector of claim 11, wherein the mounting portion is disposed in the transverse slot.

15. The connector of claim 14, wherein the mounting portion translates in a mating direction.

16. The connector of claim 11, wherein the first portion of the wire securing portion is a first pair of wings, and wherein the second portion of the wire securing portion is a second pair of wings.

17. A connector comprising:

a housing, the housing including a terminal receiving cavity, the terminal receiving cavity includes a first end and a second end, the terminal receiving cavity having an opening at the first end and a transverse slot formed in the cavity extending to a stop surface formed at the second end, and the opening further including a groove; and a terminal positioned in the terminal receiving cavity, the terminal including a planar body portion, a planar mounting portion and a contacting portion formed in a first direction and disposed between the body portion and the mounting portion, the body portion having a locking tang formed from the body portion and a rib formed from an exterior edge of the body portion, wherein the rib is positioned in the groove and the rib is configured to provide a protective envelope over the locking tang, the terminal further including a wire securing portion, the body portion being disposed between the wire securing portion and the contacting portion, the wire securing portion having a first portion configured to secure an exposed portion of a wire and a second portion configured to secure a covered portion of the wire, wherein the first portion is disposed between the second portion and the body portion.

18. The connector of claim 17, wherein the rib is formed in a second direction.

19. The connector of claim 18, wherein the second direction is opposite the first direction.

20. The connector of claim 17, wherein the ribs have a lead-in portion formed on the leading end of the rib.

21. The connector of claim 20, wherein the body portion includes a pair ribs disposed on each side of the locking tang.

22. The connector of claim 17, wherein the first portion of the wire securing portion is a first pair of wings, and wherein the second portion of the wire securing portion is a second pair of wings.

23. A connector comprising:

a housing, the housing including a terminal receiving cavity, the terminal receiving cavity includes a first end and a second end, the terminal receiving cavity having an opening at the first end and a transverse slot formed in the cavity extending to a stop surface formed at the second end; and a terminal positioned in the terminal receiving cavity, the terminal including a planar body portion and a planar mounting portion, the body portion and the mounting portion being coplanar, the terminal including a contacting portion disposed between the body portion and the mounting portion, the mounting portion having a front edge, wherein a space is defined between the front edge of the mounting portion of the terminal and the stop surface of the slot formed at the second end of the cavity.

24. The connector of claim 23, wherein the body portion and the mounting portion have a first width and the contacting portion has a second width.

25. The connector of claim 24, wherein the first width is greater than the second width.

26. The connector of claim 23, wherein the mounting portion has a width that is less than a width of the body portion.

27. The connector of claim 23, wherein the contacting portion is formed as arc shaped.

28. The connector of claim 23, wherein the mounting portion is configured to translate in a mating direction.

29. The connector of claim 23, wherein the terminal receiving cavity includes a ramped portion configured to engage the contacting portion of the terminal.

30. The connector of claim 29, wherein the ramped portion includes a flat portion having a longitudinal recessed.

31. A connector comprising:

a housing, the housing including a terminal receiving cavity, the terminal receiving cavity including a first end and a second end, the terminal receiving cavity having an opening at the first end and a transverse slot formed in the cavity extending to the second end, wherein the opening provides a diagonal distance between opposing corners; and a terminal positioned in the terminal receiving cavity, the terminal includes a planar body portion and a planar mounting portion with a contacting portion disposed between the body portion and the mounting portion, the body portion and the mounting portion being coplanar, the body portion and the mounting portion having a first width and the contacting portion having a second width, wherein the first width is greater than the diagonal distance.

32. The connector of claim 31, wherein the width of the contacting portion is less than the width of the body portion.

33. The connector of claim 31, wherein the mounting portion is disposed in the transverse slot.

34. The connector of claim 33, wherein the mounting portion translates in a mating direction.

35. A connector comprising:

a housing, the housing including a terminal receiving cavity, the terminal receiving cavity includes a first end and a second end, the terminal receiving cavity having an opening at the first end and a transverse slot formed in the cavity extending to a stop surface formed at the second end, and the opening further including a groove; and a terminal positioned in the terminal receiving cavity, the terminal including a planar body portion, a planar mounting portion and a contacting portion formed in a first direction and disposed between the body portion and the mounting portion, the body portion and the mounting portion being coplanar, the body portion having a locking tang formed from the body portion and a rib formed from an exterior edge of the body portion, wherein the rib is positioned in the groove and the rib is configured to provide a protective envelope over the locking tang.

36. The connector of claim 35, wherein the rib is formed in a second direction.

37. The connector of claim 36, wherein the second direction is opposite the first direction.

38. The connector of claim 35, wherein the ribs have a lead-in portion formed on the leading end of the rib.

39. The connector of claim 38, wherein the body portion includes a pair ribs disposed on each side of the locking tang.

* * * * *